US006138773A

United States Patent [19]

Cooper

[11] Patent Number: 6,138,773

[45] Date of Patent: Oct. 31, 2000

[54] FOUNDRY DECELERATION APPARATUS

[75] Inventor: Christopher W. Cooper, Hoover, Ala.

[73] Assignee: Action Machinery of Alabama, Inc., Helena, Ala.

[21] Appl. No.: 09/372,419

[22] Filed: Aug. 11, 1999

Related U.S. Application Data

[63] Continuation-in-part of application No. 09/309,756, May 11, 1999.

[51] Int. Cl.[7] ..... B25D 9/00

[52] U.S. Cl. ..... 173/211; 173/212; 173/128

[58] Field of Search ..... 173/210, 211, 173/212, 128, 90

[56] References Cited

U.S. PATENT DOCUMENTS 2,887,686 5/1959 Wandel et al. ..... 173/211

5,415,241 5/1995 Ruffu et al. ..... 173/212

5,573,075 11/1996 Henry et al. ..... 173/211

5,806,610 9/1998 Sapozhnikov ..... 173/128

*Primary Examiner*—Scott A. Smith

*Attorney, Agent, or Firm*—Robert J. Veal; Christopher A. Holland; Burr & Forman, LLP

[57] ABSTRACT

A improved apparatus for decelerating a piston and impacting rod assembly within a single stroke foundry impactor utilizing a non-metallic deceleration piston slidably positioned within a pressurized deceleration chamber mounted proximate the end of the bore containing the impactor piston and impacting rod assembly. The deceleration piston is biased towards the impactor bore by pressurization of the deceleration chamber, such that upon a stroke of the impactor, the residual kinetic energy of the piston and impacting rod assembly is absorbed by the biased deceleration piston.

18 Claims, 3 Drawing Sheets

FOUNDRY DECELERATION APPARATUS

This application is a continuation-in-part application of U.S. patent application Ser. No. 09/309,756 filed May 11, 1999.

FIELD OF THE INVENTION

The present invention relates to equipment used in the foundry industry, and more particularly to the impacting equipment generally used to generate an impacting force to fracture a riser or flashing from a casting product subsequent to the pouring process. With even greater particularity, the present invention relates to an improved deceleration apparatus for use in conjunction with the aforementioned impacting equipment for absorbing the excess kinetic energy generated by an impactor apparatus.

BACKGROUND OF THE INVENTION

The foundry industry has long been accustomed to the processes associated with the removal of excess cast material from cast products. In the typical foundry industry, the pouring of molten cast into molds inevitably leaves an excess portion of cast material extending from the cast product subsequent to the cooling of the molten material. This excess portion, often termed a neck or riser, is formed as a result of molten cast remaining in the pour hole of the mold during the pouring and cooling process. Once the exterior mold is removed from the cast product, the cast material previously remaining in the mold pour hole becomes riser extending from the cast product. This riser must be removed from the casting in order to yield a finished cast product.

The foundry industry utilizes various forms of single stroke pneumatic impactors to fracture a riser from cast products. These pneumatic single stroke impactors typically comprise a longitudinal bore having a piston slidably mounted therein, which is mechanically connected to a slidably extendable impacting rod. The piston is urged to travel longitudinally within the bore via selective pressurization of the head or blind end of the bore by a high-pressure air supply in fluid connection with the bore through selectively actuated valves, thus selectively extending and retracting the impacting rod. However, in order to impart sufficient velocity and inertia to the impacting rod to fracture the riser from the cast material, the bore must be rapidly pressurized by the opening of the aforementioned valves. In operation, the operator of the impactor simply aligns the retracted impacting rod with the riser to be fractured and activates the appropriate valve to accelerate and extend the impacting rod so that the riser to be fractured is contacted by the rapidly extending rod. The impacting rod transfers a substantial amount of kinetic energy to the stationary riser, thereby fracturing the riser from the casting.

However, a common cause of impactor critical failure is the frequent occurrence of partial or complete misses of the target riser to be fractured by the impacting rod. In these circumstances, the piston and impacting rod maintain a substantial amount of kinetic energy, which the impactor must then absorb. Generally speaking, upon a miss of the target riser by the impacting rod, the piston continues to travel toward the head end of the bore at or near maximum velocity. Upon reaching the head end of the bore, the piston contacts the head end and comes to a sudden stop. This sudden stop increases material stresses and often results in critical fractures in either the piston or the bore assembly. Additionally, a similar problem occurs when an impactor is used to fracture relatively small risers and such from castings, as the piston and rod assembly is only minimally decelerated by the impact with the small riser. Therefore, the piston and rod continue to longitudinally travel through the bore subsequent to impacting a small riser, thus again contacting the head end and potentially causing damage to the impactor components.

In order to lessen these material stresses, manufacturers of foundry impactors have attempted to decrease the head end velocity of the piston and impacting rod via rapid repressurization of the head end of the bore proximate the end of the impactor stroke. In practice, this concept involves precisely timing the opening of a valve connecting a high-pressure air supply to the head end of the bore proximate the end of the stroke. In theory this practice effectively reduces the head end velocity of the piston and impacting rod; however, in practice this configuration produces numerous disadvantages and is nearly ineffective. Inasmuch as this configuration utilizes a substantial portion of the bore for the deceleration process, the output power of the impactor is substantially diminished, as the length of the power stroke must be reduced to accommodate the deceleration portion of the bore. Thus, in order to generate adequate impacting power using this configuration, a substantially longer bore is required, which directly translates into larger impactor dimensions. Additionally, the timing of the opening of the repressurization valve is critical to the safe operation of the apparatus, as improper timing can again result in critical failure of the impactor and possible injury to the operator. Further, inasmuch as this configuration rapidly pressurizes the head end of the bore to decrease piston velocity, the resulting piston velocity at the blind end becomes an issue, as the piston is urged to reverse it's longitudinal direction of motion and rapidly travel towards the blind end of the bore upon pressurization of the head end. Thus, deceleration of the piston at the blind end becomes an issue, if additional critical failures are to be avoided.

SUMMARY OF THE INVENTION

Accordingly, it is the object of the present invention to provide an improved apparatus for decelerating a piston and rod assembly within a single stroke impactor. It is a further object of the present invention to provide an improved apparatus for decelerating an impactor piston and rod assembly without substantially increasing the exterior dimensions of the impactor. It is yet a further object of the present invention to provide an improved apparatus for decelerating an impactor piston and rod assembly without decreasing the output power of the impactor. Further yet, it is an object of the present invention to provide an improved impactor piston deceleration apparatus manufactured from materials capable of sustained impacting operation without major maintenance, thus substantially prolonging the operating life of the impactor. Other features, objects, advantages, and methods of use of the present invention will become apparent from a thorough reading of the following description as well as a study of the appended drawings.

BRIEF DESCRIPTION OF THE DRAWINGS

The apparatus embodying features of the present invention are illustrated in the enclosed drawings, which form a portion of this disclosure and wherein.

DESCRIPTION OF THE PREFERRED EMBODIMENT

Figure 1:
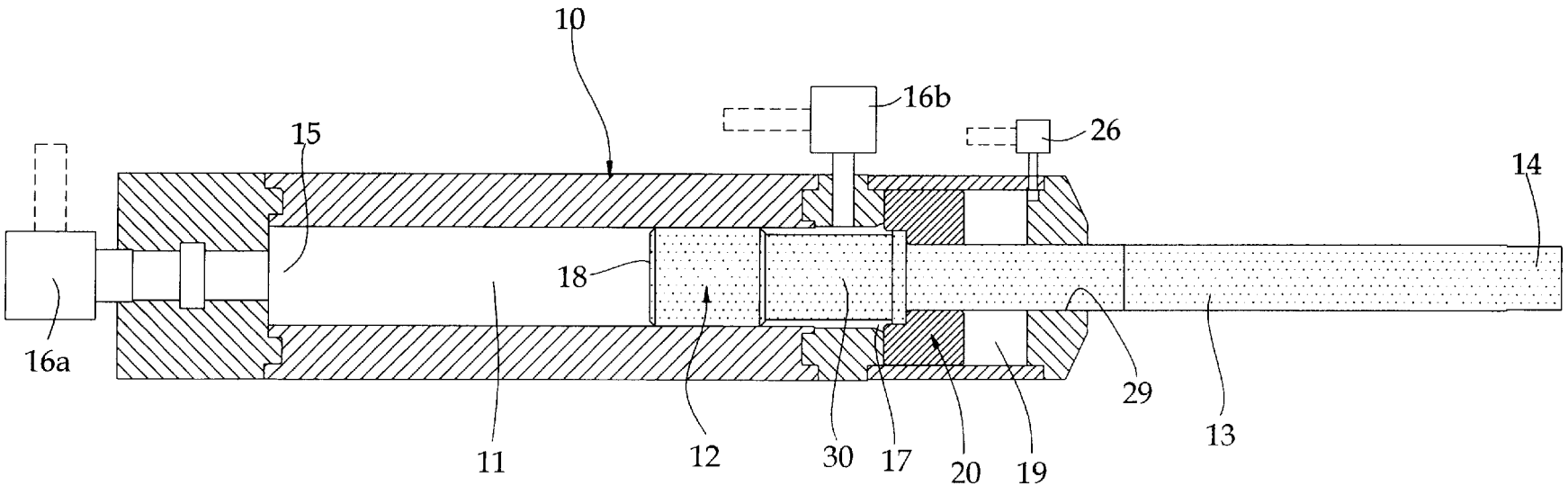
FIG. 1 is a sectional view of an improved foundry impactor.

Referring to the drawings for a better understanding of the principles of operation and structure of the invention, it will be seen that FIG. 1 shows a complete sectional view of an improved foundry impactor. Such an impactor generally comprises an elongated casing 10 having a concentric inner sleeve defining a power bore 11. Power bore 11 includes a piston assembly 12 slidably mounted therein for longitudinal movement within power bore 11. Piston assembly 12 includes an elongated impacting rod 13 having a longitudinally displaceable hammer end 14 for impacting a riser to be fractured from a casting upon a stroke of piston assembly 12. Piston assembly 12 is longitudinally displaced within power bore 11 via the introduction of fluid into power bore 11. First fluid introduction valve 16*a*, which is positioned proximate the blind end 15 of power bore 11, operates to introduce fluid into the blind end 15 of power bore 11, such that piston assembly 12 is urged to travel towards the head end 17 of power bore 11. This longitudinal movement concomitantly acts to extend the hammer end 14 beyond the exterior of casing 10 for the purpose of impacting a casting. A second fluid introduction valve 16*b* positioned proximate the head end 17 of power bore 11 is provided to inject fluid into the head end 17 of power bore 11. The injection of fluid into the head end 17 of power bore 11 causes piston assembly 12, and thus impacting rod 13 and hammer end 14, to return to the blind end 15 of power bore 11 in preparation for another impacting stroke.

Figure 2:
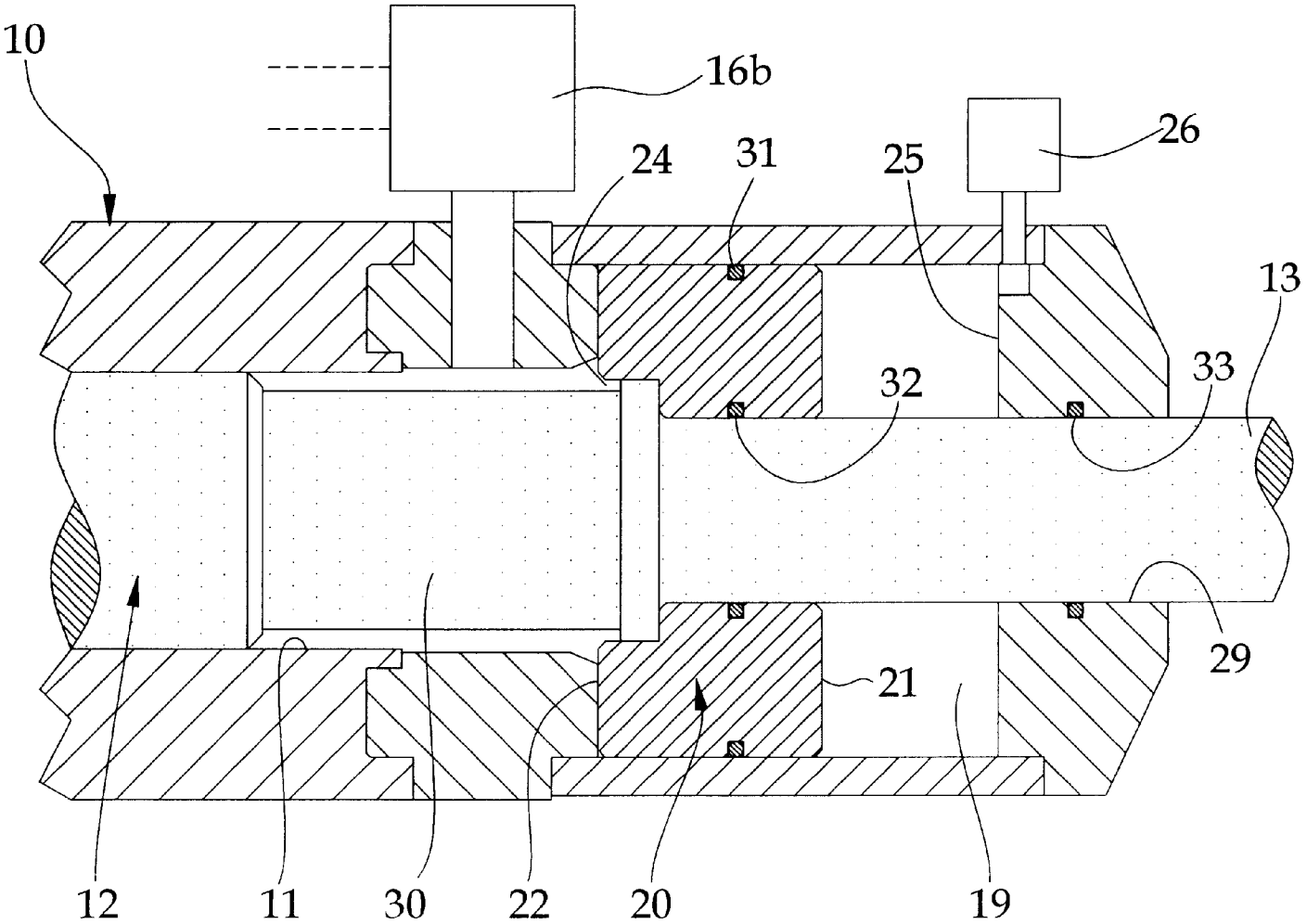
FIG. 2 is a sectional view of deceleration chamber.

Coaxially affixed to casing 10 immediately adjacent head end 17 of power bore 11 is a deceleration chamber 19. With particularity, deceleration chamber 19, which is clearly shown in FIG. 2 of the accompanying drawings, comprises a longitudinally continuous outer wall forming a substantially circular inner chamber 19 of sufficient diameter to receive annular deceleration piston 20 therein. Deceleration chamber 19 includes a first open end 24 in fluid communication with head end 17 of power bore 11, and a second substantially closed end 25 having only a coaxially aligned longitudinal bore 29 formed therein for cooperatively and concentrically receiving impacting rod 13 therethrough. Open end 24 of deceleration chamber 19 is rigidly mounted to the head end 17 of power bore 11 along the same longitudinal axis as power bore 11, such that power bore 11 and deceleration chamber 19 can be independently pressurized. Further, deceleration chamber 19 cooperatively receives impacting rod 13 therethrough along a common longitudinal axis with power bore 11. A deceleration chamber pressurization valve 26 is positioned proximate closed end 35 of deceleration chamber 19. Pressurization valve 26 is a selectively actuated bi-directional valve in fluid communication with both a high-pressure air supply and the ambient atmosphere. Valve 26 operates to selectively pressurize deceleration chamber 19, such that deceleration piston 20 is urged proximate open end 24 of deceleration chamber 19 in preparation for contacting piston assembly 12 upon a stroke of such. Alternatively, valve 26 also serves to selectively depressurize deceleration chamber 19 to atmospheric pressure during maintenance periods, such that any excess oil or unwanted particles that may hinder proper operation of deceleration piston 20 can be purged or allowed to escape from deceleration chamber 19.

Figure 3:
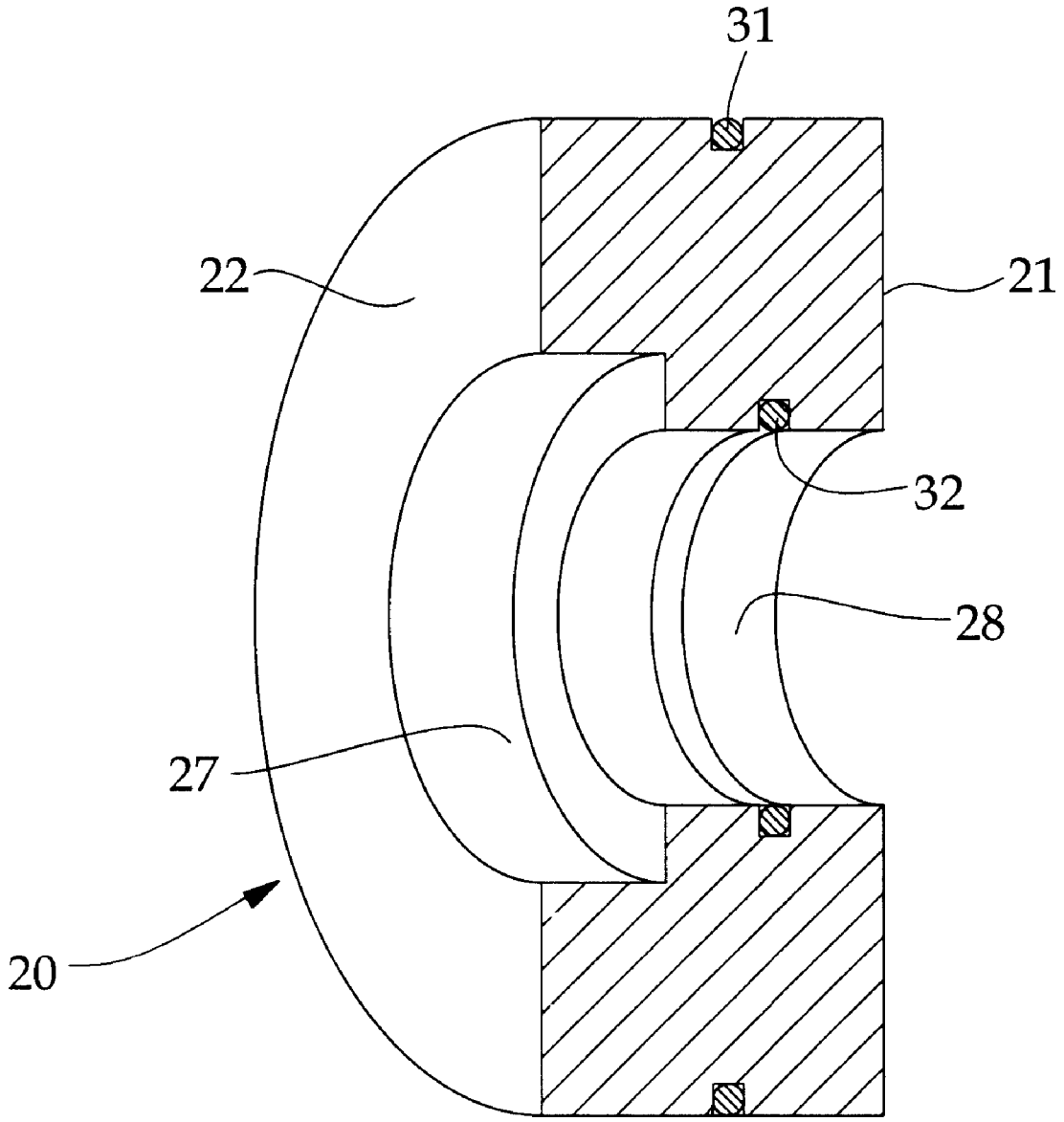
FIG. 3 is a perspective view of the deceleration piston.

Deceleration piston 20, as shown in FIG. 3, comprises a circular disk having an axial bore 28 formed therein for slidably receiving impacting rod 13 therethrough to the exterior of impactor casing 10 cooperatively with longitudinal bore 29 in closed end 25 of deceleration chamber 19. As a result of axial bore 28, deceleration piston 20 is generally annular in shape. Power bore side 22 of deceleration piston 20 includes an axially formed recess 27 in the form of a partial bore of sufficiently larger diameter than axial bore 28 to accommodate lower portion 30 of piston assembly 12. Opposite power bore side 22 of deceleration piston 20 is deceleration chamber side 21 of deceleration piston 20, which is generally planar in form. Inasmuch as recess 27 operates to receive piston assembly 12 therein for the purpose of longitudinally decelerating the piston assembly 12, the diameter of recess 27 is generally slightly larger than that of the lower portion 30 of piston assembly 12. Further, inasmuch as axial bore 28 and longitudinal bore 29 both slidably receive impacting rod 13 therethrough, the diameter of these particular bores is also slightly larger than that of impacting rod 13.

As a result of deceleration piston 20 continuously receiving and absorbing the kinetic energy of piston assembly 12 and impacting rod 13 upon a stroke of the impactor, it is critical that deceleration piston 20 be manufactured of a material capable of continually absorbing such kinetic energy while maintaining structural integrity. Thus, rigid metallic compounds commonly utilized to construct piston assemblies, such as iron and aluminum compounds, are to be avoided, as the potential for metal fatigue and fracture as a result of continuous impacting strokes is high. Therefore, in the preferred embodiment deceleration piston 20 is manufactured from a non-metallic compound, such as nylon, a family of high-strength, resilient synthetic polymers, the molecules of which contain the recurring amide group CONH, or equivalents. The use of these compounds dramatically increases the ability of deceleration piston 20 to resist fracturing due to continuous high energy impacts with piston assembly 12, and therefore, the life span of deceleration piston 20 is dramatically increased. Particularly, it is contemplated within the preferred embodiment to manufacture deceleration piston 20 from a heat stabilized type 6 cast polyamide resin nylon compound offering long-term thermal stability at high temperatures.

In order to maintain pressurization of deceleration chamber 19 during operation of impactor 10, deceleration piston 20 is equipped with two sets of pressure seals, which are generally known in the art. First pressure seal 31 is positioned about the outer circumference of deceleration piston 20 in similar fashion to a common ring seal type arrangement, such that a seal is formed between the outer circumference of deceleration piston 20 and the wall of deceleration chamber 19. Second pressure seal 32 is positioned about axial bore 28 of deceleration piston 20 again in similar fashion to ring type seals, such that a seal is formed between axial bore 28 and the outer surface of impacting rod 13. Although not located on deceleration piston 20, a third pressure seal 33 located between longitudinal bore 29 and impacting rod 13 completes the pressurization seals of deceleration chamber 19 by sealing chamber 19 from the exterior of the impactor. The presence of these pressure seals allows for the selective pressurization of deceleration chamber 19, such that deceleration piston 20 is adequately biased against longitudinal movement to decelerate piston assembly 12.

Therefore, prior to impacting a casting with impactor 10, deceleration chamber 19 must be pressurized in order to be capable of properly decelerating piston assembly 12. Thus, deceleration chamber valve 26 is actuated such that deceleration chamber 19 becomes in fluid communication with a high-pressure air supply. This causes the volume within deceleration chamber 19 to be pressurized, which in turn urges deceleration piston 20 to longitudinally travel to power bore end 24 of deceleration chamber 19 in preparation for receiving piston assembly 12. Thereafter, deceleration chamber 19 and deceleration piston 20 are ready to receive and decelerate piston assembly 12 upon an impacting stroke. Upon actuation of first fluid introduction valve 16*a*, blind end 15 of power bore 11 becomes pressurized, and thus urges piston assembly 12 to rapidly travel towards head end 17 of power bore 11. As piston assembly 12 longitudinally travels through power bore 11 during the end portion of an impacting stroke, the lower portion 30 of piston assembly 12 is concentrically received within recess 27 of deceleration piston 20. Thereafter, deceleration piston 20 and piston assembly 12 begin to concomitantly travel longitudinally within power bore 11 and deceleration chamber 19. However, as a result of the pressurization of deceleration chamber 19, deceleration piston 20 is firmly biased against such longitudinal movement. Therefore, as deceleration piston 20 begins to longitudinally travel within deceleration chamber 19, the volume of air within deceleration chamber 19 is substantially compressed. This compression directly and proportionally increases the resistance force applied to deceleration chamber side 21 of deceleration piston 20, such that further longitudinal movement of deceleration piston 20 is resisted with an increasing resistive force. Therefore, the concomitant longitudinal movement of piston assembly 12 and deceleration piston 20 is quickly damped to zero as a result of the increasing biasing force opposing the concomitant longitudinal movement.

It is to be understood that the form of the invention as shown herein is a preferred embodiment thereof and that various changes and modifications may be made therein without departing from the spirit of the invention or scope as defined in the following claims

What I claim is:

1. An improved apparatus for decelerating a driven piston and impacting rod assembly slidably mounted within the power bore of a single stroke foundry impactor proximate the end portion of an impacting stroke wherein said improved deceleration apparatus comprises:

a) a cylindrical deceleration chamber of greater diameter than said power bore having a first substantially open terminating end and a second substantially closed terminating end, said first terminating end being rigidly mounted to the head end of said power bore such that said power bore and said deceleration chamber share a common longitudinal axis; and b) a biased disk shaped deceleration piston having an engaging surface and a resistance surface, said deceleration piston being slidably mounted within said deceleration chamber for longitudinal movement therein, said deceleration piston having an axial bore formed therein for slidably receiving said impacting rod therethrough and a circular recess circumscribing said axial bore formed in said engagement surface for receiving said piston assembly.

2. An improved apparatus for decelerating a driven piston and impacting rod assembly slidably mounted within the power bore of a single stroke foundry impactor proximate the end portion of an impacting stroke as defined in claim 1, wherein said second substantially closed terminating end further comprises a longitudinal bore formed therein for communicating said impacting rod therethrough to the exterior of said impactor, the interior surface of said bore having means for slidably engaging and creating a pressure seal with the exterior surface of said impacting rod.

3. An improved apparatus for decelerating a driven piston and impacting rod assembly slidably mounted within the power bore of a single stroke foundry impactor proximate the end portion of an impacting stroke as defined in claim 1, wherein said deceleration piston further comprises means positioned on the surface of said axial bore for slidably engaging and creating a pressure seal with the exterior of said impacting rod and means positioned about the outer circumference of said deceleration piston for slidably engaging said deceleration chamber and creating a pressure seal therewith.

4. An improved apparatus for decelerating a driven piston and impacting rod assembly slidably mounted within the power bore of a single stroke foundry impactor proximate the end portion of an impacting stroke as defined in any of the preceding claims, wherein said deceleration piston is biased towards said head end of said power bore by pressurization of said deceleration chamber.

5. An improved apparatus for decelerating a driven piston and impacting rod assembly slidably mounted within the power bore of a single stroke foundry impactor proximate the end portion of an impacting stroke as defined in claim 1, wherein said deceleration piston is manufactured from a non-metallic material.

6. An improved apparatus for decelerating a driven piston and impacting rod assembly slidably mounted within the power bore of a single stroke foundry impactor proximate the end portion of an impacting stroke as defined in claim 5, wherein said non-metallic material is a nylon compound.

7. An improved apparatus for decelerating a driven piston and impacting rod assembly slidably mounted within the power bore of a single stroke foundry impactor proximate the end portion of an impacting stroke as defined in claim 6, wherein said nylon compound further comprises a heat stabilized type six polyamide resin nylon compound.

8. An improved deceleration apparatus for absorbing the excess kinetic energy of a driven piston an impacting rod assembly slidably mounted within the power bore of a single stroke foundry impactor, wherein said improved deceleration apparatus comprises:

a) a deceleration chamber having a first substantially open end and a second substantially closed end, said first end being interconnected to said second end by deceleration chamber walls, said first end being rigidly mounted to the head end of said power bore such that said power bore and said deceleration chamber share a common longitudinal axis; and b) a biased deceleration piston having a first and second substantially planar opposing surfaces slidably mounted within said deceleration chamber for longitudinal movement therein, said deceleration piston having a bore formed therein for slidably receiving said impacting rod therethrough and a recess circumscribing said bore for engaging said piston assembly proximate the end of a stroke of said piston.

9. An improved deceleration apparatus for absorbing the excess kinetic energy of a driven piston an impacting rod assembly slidably mounted within the power bore of a single stroke foundry impactor as defined in claim 8, wherein said second end further comprises a bore formed therein for slidably communicating said impactor rod therethrough to the exterior of said impactor upon a stroke of said drive piston and impacting rod assembly.

10. An improved deceleration apparatus for absorbing the excess kinetic energy of a driven piston an impacting rod assembly slidably mounted within the power bore of a single stroke foundry impactor as defined in claim 8, wherein said deceleration piston further comprises means for maintaining a differential from said first surface side of said deceleration piston to said second surface side of said deceleration piston.

11. An improved deceleration apparatus for absorbing the excess kinetic energy of a driven piston an impacting rod assembly slidably mounted within the power bore of a single stroke foundry impactor as defined in claim 8, wherein said deceleration piston is manufactured from a non-metallic material.

12. An improved deceleration apparatus for absorbing the excess kinetic energy of a driven piston an impacting rod assembly slidably mounted within the power bore of a single stroke foundry impactor as defined in claim 11, wherein said non-metallic material is a type six nylon compound.

13. An improved deceleration apparatus for absorbing the excess kinetic energy of a driven piston an impacting rod assembly slidably mounted within the power bore of a single stroke foundry impactor as defined in claim 12, wherein said type six nylon compound is a heat stabilized polyamide resin.

14. An improved deceleration apparatus for absorbing the excess kinetic energy of a driven piston an impacting rod assembly slidably mounted within the power bore of a single stroke foundry impactor as defined in claim 8, wherein said deceleration piston is biased towards said head end of said power bore by selective pressurization of said deceleration chamber on said second surface side of said deceleration piston.

15. An improved deceleration apparatus for absorbing the excess kinetic energy of a driven piston an impacting rod assembly slidably mounted within the power bore of a single stroke foundry impactor, wherein said improved deceleration apparatus comprises:

a) a cylindrically shaped deceleration chamber of greater diameter than said power bore having a first open end rigidly attached to the head end of said power bore such that said power bore and said deceleration chamber share a common longitudinal axis, and a second closed end having a bore formed therein along the longitudinal axis of said deceleration chamber for slidably receiving said impacting rod therethrough; and b) an annularly shaped deceleration piston having a longitudinal aperture formed therein for slidably receiving said impacting rod therethrough, said annulus having a first piston engaging side and a second deceleration chamber side slidably mounted within said deceleration chamber for longitudinal movement therein, said annulus having a circular recess circumscribing the aperture of said annulus for receiving said piston assembly proximate the end of a stroke.

16. An improved deceleration apparatus for absorbing the excess kinetic energy of a driven piston an impacting rod assembly slidably mounted within the power bore of a single stroke foundry impactor as defined in claim 15, wherein said annularly shaped deceleration piston is biased towards the head end of said power bore by selective pressurization of said deceleration chamber on said deceleration chamber side of said annularly shaped deceleration piston.

17. An improved deceleration apparatus for absorbing the excess kinetic energy of a driven piston an impacting rod assembly slidably mounted within the power bore of a single stroke foundry impactor as defined in claim 15, wherein said annularly shaped deceleration piston is manufactured from a non-metallic material.

18. An improved deceleration apparatus for absorbing the excess kinetic energy of a driven piston an impacting rod assembly slidably mounted within the power bore of a single stroke foundry impactor as defined in claim 17, wherein said non-metallic material is a heat stabilized polyamide resin nylon compound.

* * * * *